US010695931B2

(12) United States Patent
Perini

(10) Patent No.: US 10,695,931 B2
(45) Date of Patent: Jun. 30, 2020

(54) APPARATUS AND METHOD FOR MOVING LOGS WITHIN CUTTING-OFF MACHINES

(71) Applicant: Fabio Perini, Viareggio (IT)

(72) Inventor: Fabio Perini, Viareggio (IT)

( * ) Notice: Subject to any disclaimer, the term of this patent is extended or adjusted under 35 U.S.C. 154(b) by 0 days.

(21) Appl. No.: 14/138,579

(22) Filed: Dec. 23, 2013

(65) Prior Publication Data

US 2014/0102272 A1 Apr. 17, 2014

Related U.S. Application Data

(60) Continuation of application No. 12/054,670, filed on Mar. 25, 2008, now abandoned, which is a division of application No. 10/547,435, filed as application No. PCT/IT2004/000139 on Mar. 22, 2004, now abandoned.

(30) Foreign Application Priority Data

Apr. 24, 2003 (IT) ..... FI2003A0115

(51) Int. Cl.

| | |
|---|---|
| ***B26D 7/06*** | (2006.01) |
| ***B26D 3/16*** | (2006.01) |
| ***B26D 7/02*** | (2006.01) |
| *B26D 7/01* | (2006.01) |

(52) U.S. Cl.

CPC ..... *B26D 7/0608* (2013.01); *B26D 3/161* (2013.01); *B26D 7/02* (2013.01); *B26D 7/0625* (2013.01); *B26D 7/0683* (2013.01); *B26D 2007/013* (2013.01); *Y10T 83/04* (2015.04); *Y10T 83/0515* (2015.04); *Y10T 83/2183* (2015.04); *Y10T 83/4792* (2015.04); *Y10T 83/647* (2015.04); *Y10T 83/654* (2015.04)

(58) Field of Classification Search

CPC ..... B26D 7/06; B26D 7/0608; B26D 7/0625; B26D 7/0641; B26D 3/16; B26D 3/166; B27B 1/00; B27B 1/002; B27B 31/006

USPC ..... 83/207, 251, 260–262, 270, 276, 279, 83/435.2, 436.2, 437.1, 732, 155, 155.1, 83/206, 209

See application file for complete search history.

(56) References Cited

U.S. PATENT DOCUMENTS

| | | | | |
|---|---|---|---|---|
| 4,922,773 | A * | 5/1990 | Ito | B26D 1/09 198/345.1 |
| 5,680,802 | A * | 10/1997 | Murray | 83/23 |
| 6,763,748 | B2 * | 7/2004 | Wolcott et al. | 83/29 |
| 6,837,030 | B2 * | 1/2005 | Drebing | B26D 1/16 53/250 |
| 7,213,493 | B2 * | 5/2007 | Cote | B26D 1/09 83/273 |

(Continued)

*Primary Examiner* — Phong H Nguyen

(74) *Attorney, Agent, or Firm* — McGlew and Tuttle, P.C.

(57) ABSTRACT

Apparatus for moving logs (2) within cutting-off machines. The apparatus includes a platform (1) with one or more longitudinal channels (10) inside which the logs to be cut are disposed, and a pusher device (3) acting in correspondence of the platform (1) and intended for acting on the back of the logs (2) to push them, along respective guide channels (10), toward a cutting device (4) disposed downstream. The apparatus includes a clamping device (5) disposed intermediate between the pusher device (3) and the cutting device (4) and intended for engaging the logs (2) which are pushed along the channels (10) of platform (1) by the pusher device (3) and driving them along up to the cutting device (4).

20 Claims, 9 Drawing Sheets

(56) References Cited

U.S. PATENT DOCUMENTS

2001/0047705 A1* 12/2001 Gambini ..... 83/330
2002/0170398 A1* 11/2002 Verhaeghe ..... 83/13

* cited by examiner

APPARATUS AND METHOD FOR MOVING LOGS WITHIN CUTTING-OFF MACHINES

CROSS REFERENCE TO RELATED APPLICATIONS

This application is a continuation under 37 CFR 1.53(b) of pending prior application Ser. No. 12/054,670 filed Mar. 25, 2008 and claims the benefit under 35 U.S.C. § 120 of prior application Ser. No. 10/547,435 filed Aug. 25, 2005 and claims the benefit under 35 U.S.C. § 119 of International Application PCT/IT 2004/000139 of Mar. 22, 2004, which designated inter alia the United States and which claims the priority of Italian Application FI2003A000115 of Apr. 24, 2003. The entire contents of each application is hereby incorporated by reference in its entirety.

FIELD OF THE INVENTION

The present invention pertains to an apparatus and a method for moving logs within cutting-off machines. In the following text, the term "logs" is meant to indicate rolls of web material (such as paper) wound up around a support core (for example, a tubular cardboard core), to be cut to form rolls of smaller length, that is, of commercial size.

BACKGROUND OF THE INVENTION

The production of paper rolls is known to involve cutting transversally the logs, produced by a rewinding machine, by using one or more cutting-off machines.

A cutting-off machine for logs is described in details in the patent IT 1247330.

Essentially, a cutting-off machine of this type comprises:

- a plurality of channels or guides into which the logs are discharged and in correspondence of which movable devices, so-called "porters" in jargon, are mounted to drive the logs into longitudinal motion by pushing them from behind;
- a cutting station, comprising one or more circular blades, rotating about axes parallel to those of the logs and fixed on a corresponding movable support.

During the normal operation, a log to be cut is disposed, by a relevant porter, in a preset position on the respective guide and blocked in such position; then, one of the blades is actuated, that is, it is driven into a plane orthogonal to the axis of the log, so as to form a shorter roll of preset size therefrom. The length of the roll depends, actually, on the advancement of the porter during the time elapsing between two consecutive cuts operated by the blades.

In particular, the feeding of the logs to the cutting means is of discontinuous nature, as an empty space results all the time between one log and the next, and because it is in fact impossible to use the system with porters of known type to feed the logs continually.

Such discontinuity in the supply brings about a decreased production, in terms of number of rolls per hour being produced, with respect to the actual capacity of the system. A further drawback is that the components of the system are likely to collide with each other in case of failures in the system predisposed for moving the porters and the cutting means in synchronism, which affects negatively the economy of the manufacturing process.

SUMMARY OF THE INVENTION

The main object of the present invention is to overcome the above drawbacks.

This result has been achieved, according to the invention, by adopting the idea of a structure and a method having the characteristics described in independent claims. Further characteristics being set, forth in the dependent claims.

The present invention makes it possible to continuously feed the logs to cutting means, with no interruptions nor empty spaces between consecutive logs, which allows improving significantly the actual output of the system and without any interference between the means for driving the logs and the cutting means. Moreover, an apparatus according to the invention is relatively easy to make, cost-effective and reliable even after a prolonged service life.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
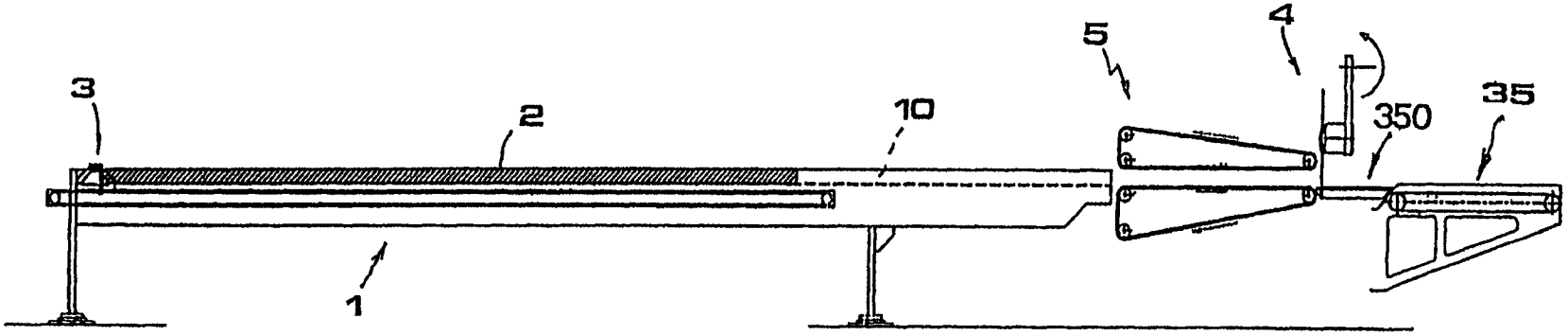
FIG. 1 is a schematic side view of an apparatus, according to the invention, showing the step at the beginning of a work cycle.

Reduced to its basic structure, and reference being made to the figures of the attached drawings, an apparatus according to the invention comprises:

- a platform (1) with one or more longitudinal channels (10) inside which the logs to be cut are disposed;
- pusher means (3) acting in correspondence of said platform (1) and intended for acting on the back of the logs (2) to push them, along respective guide channels (10), toward cutting means (4) disposed downstream;
- clamping means (5) disposed intermediate between said pusher means (3) and said cutting means (4) and intended for engaging the logs (2) which are pushed along the channels (10) of platform (1) by the pushers (3) and driving them along as far as said cutting means (4).

Figure 14:
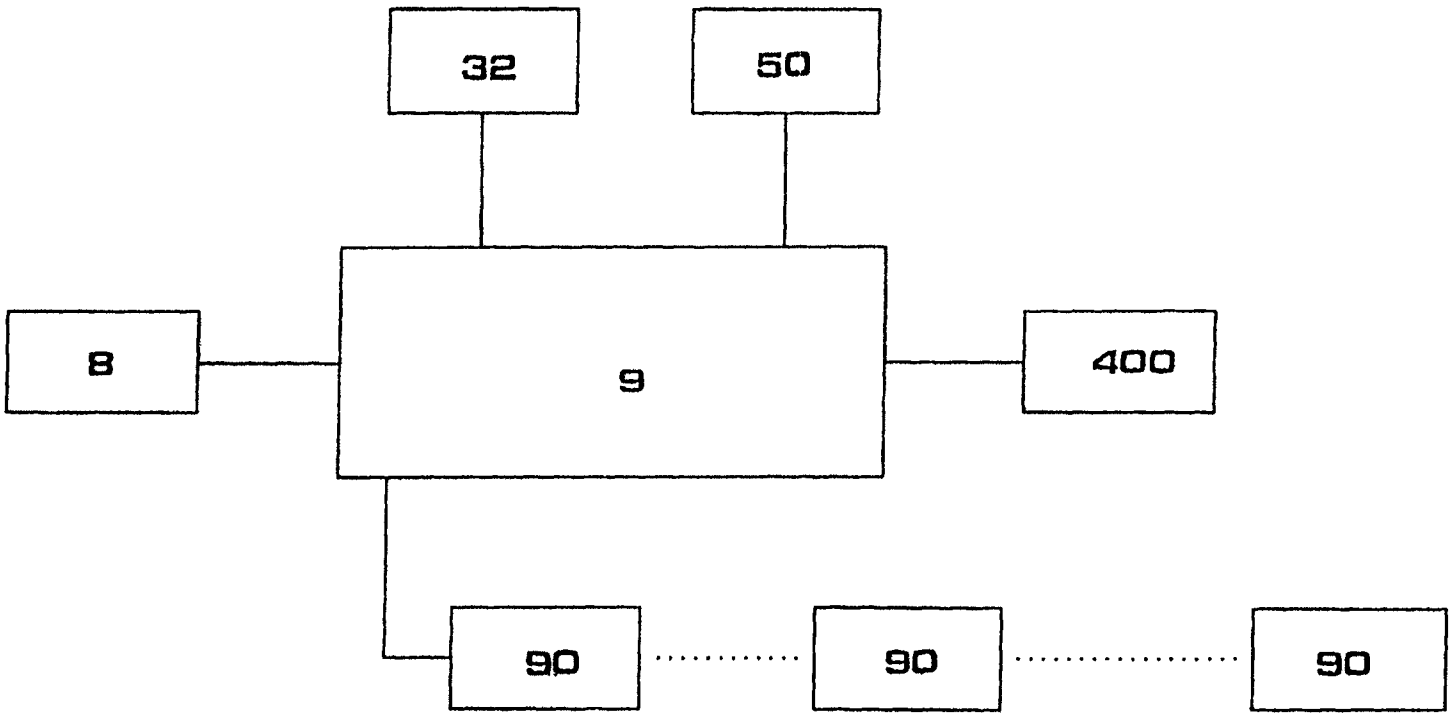
FIG. 14 is a simplified block diagram of the automatic drive and control means.

Advantageously, the pusher means (3) comprise a bar (30) disposed transverse to the channels (10) of platform (1) and moved to and from the clamping means (5) by a carriage (31) associated with a corresponding electric motor (32) (shown only in the block diagram of FIG. 14) and mounted for sliding on the two long sides of platform (1).

Moreover, advantageously, the clamping means (5) are made up of two motor-driven, loop-closed belts (50) disposed opposite to each other, with respect to the plane (2) on which the logs (2) arrive sliding on the platform (1), so that each belt will always exhibit a length (51) parallel to such plane: the lengths facing each other (51) of the belts (50) being spaced apart of an extension substantially equal to the outer diameter of the logs (2).

For example, reference being made to the attached drawings, the cutting means (4) comprise a blade (40) mounted on a support arm (41) which is associated with a relevant actuator (400) (see block diagram of FIG. 14) to drive it into motion from and to the logs (2) to be cut.

The operation of the above described apparatus is as follows.

Figure 2:
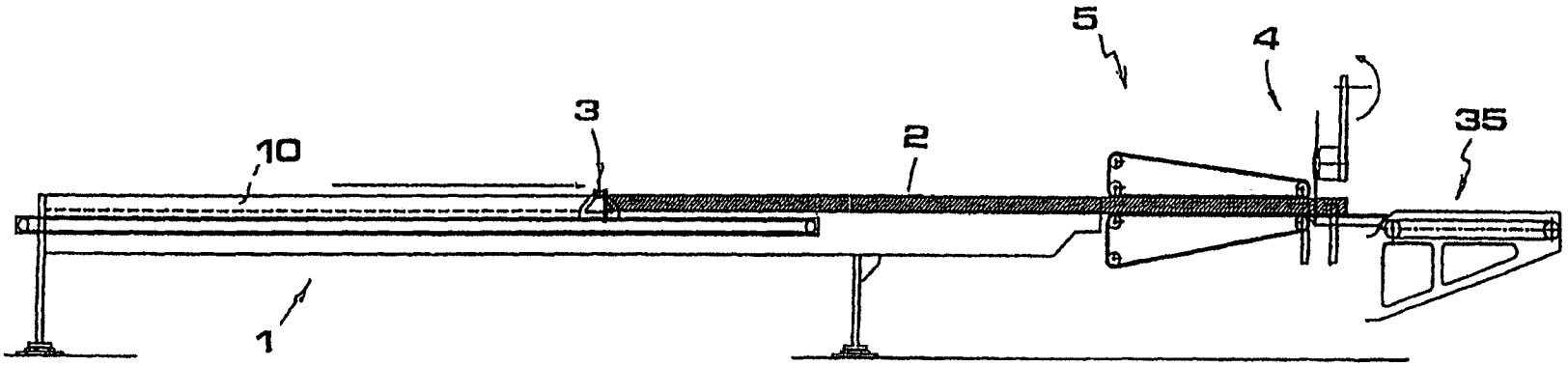
FIG. 2 shows the apparatus of FIG. 1 with a log engaged by clamping means and subjected to a cutting operation.
Figure 3:
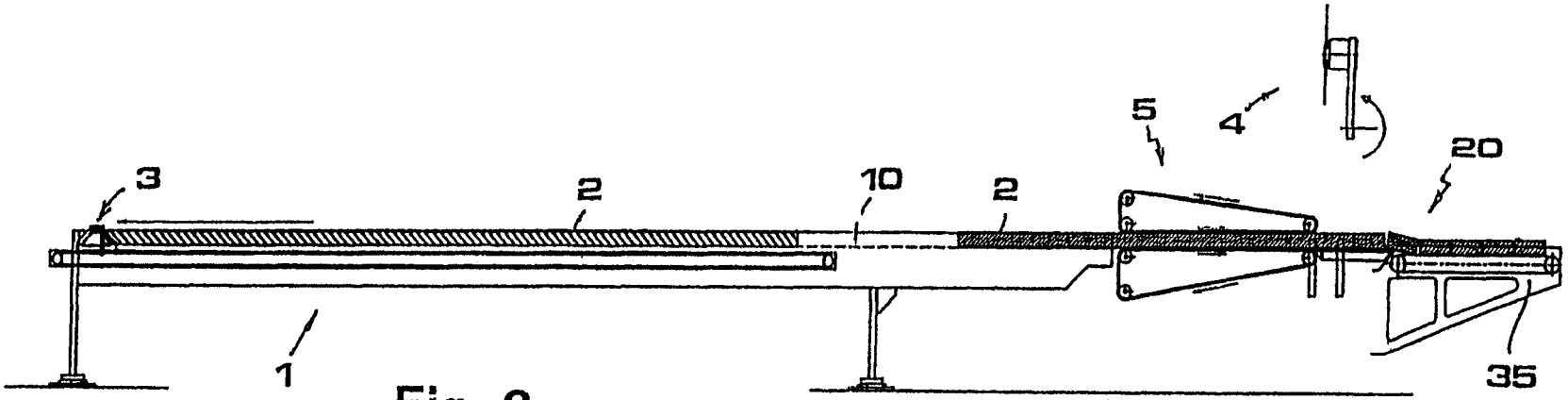
FIG. 3 shows the apparatus of FIG. 1 with another log loaded onto the respective channel of the platform for the sliding of the logs.
Figure 4:
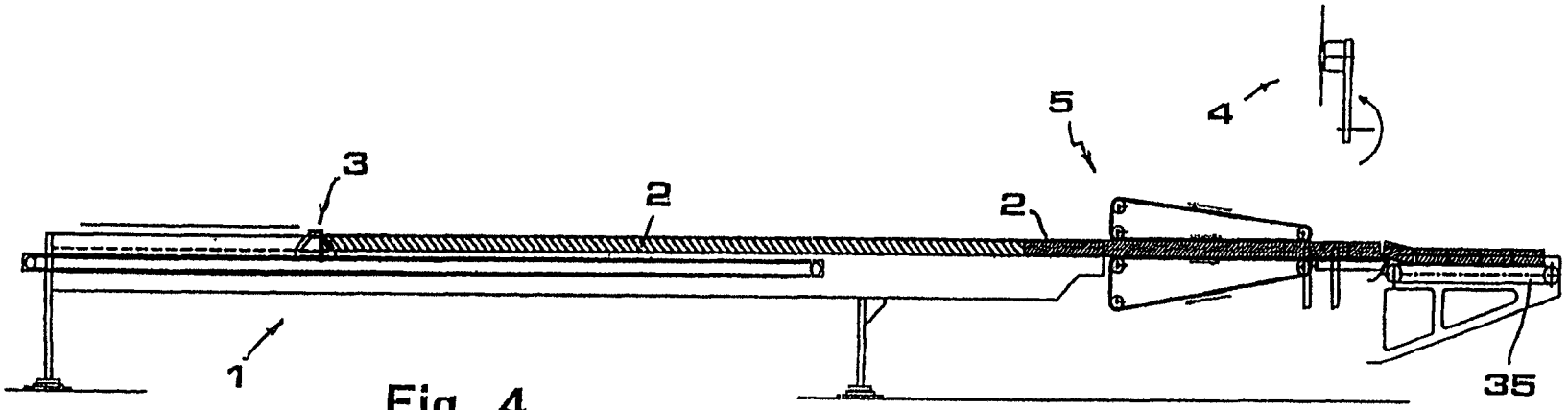
FIG. 4 shows the apparatus of FIG. 1 with two logs lined up one after the other.
Figure 5:
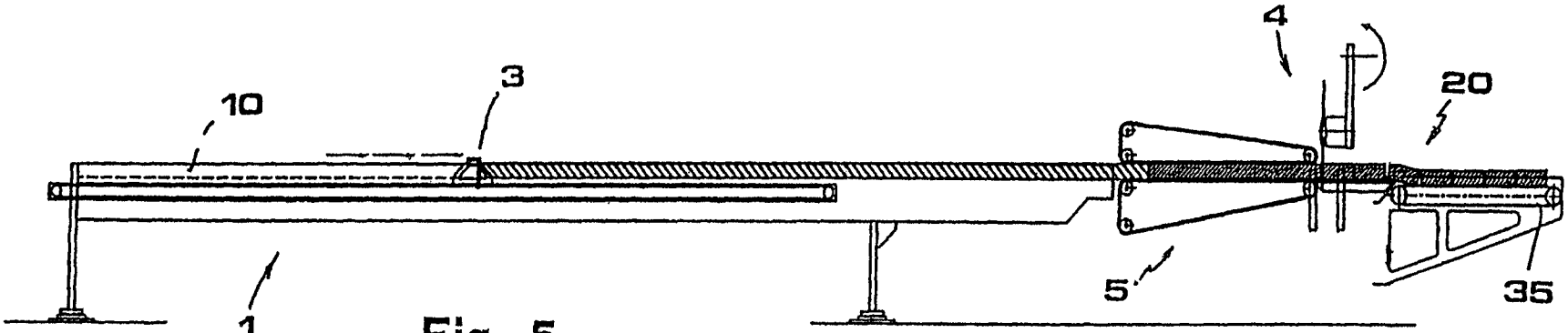
FIG. 5 shows the apparatus of FIG. 4 with the second log having its head section positioned between the clamping means.
Figure 6:
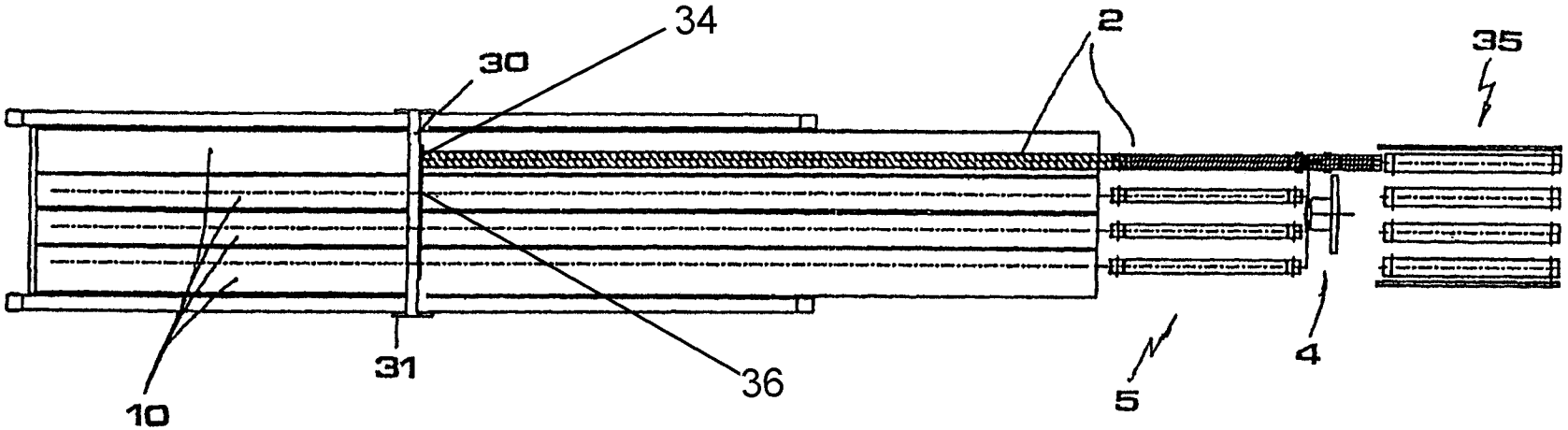
FIG. 6 shows a plan view of the apparatus of FIG. 5.
Figure 7:
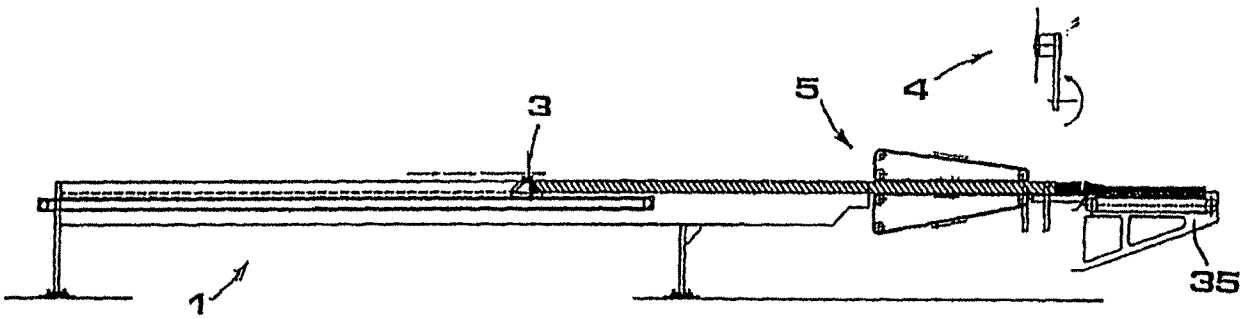
FIGS. 7 and 8 show the same apparatus in two operating steps that follow the one represented in FIG. 6.
Figure 8:
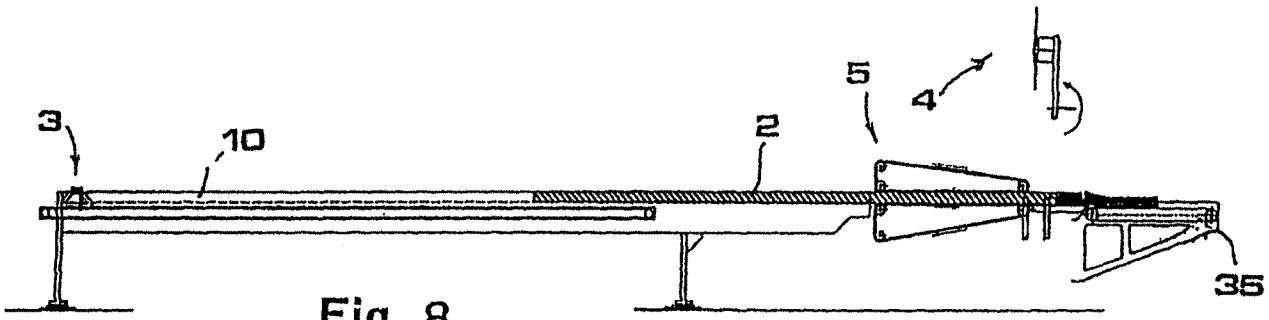
Figure 9:
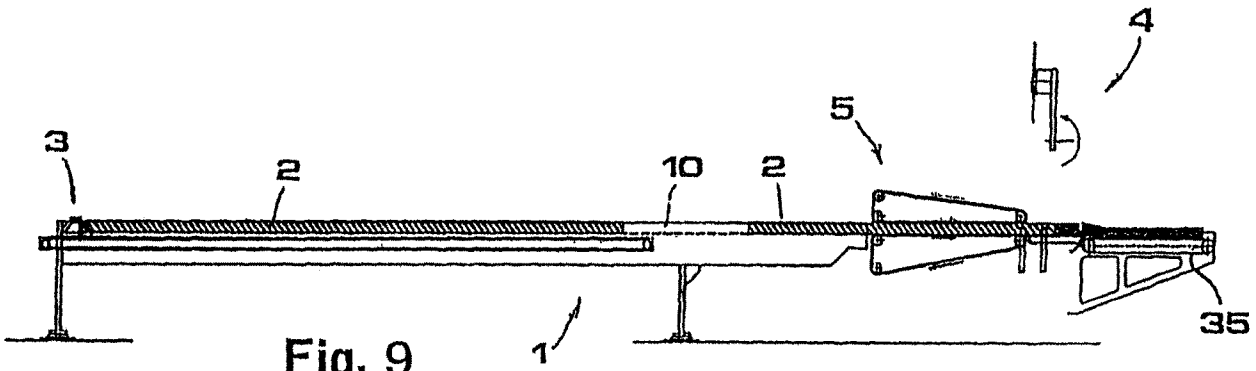
FIG. 9 shows also the same apparatus in a further step, with another log loaded on the platform.

The logs (2) are disposed in the channels (10) of platform (1) by automatic loading devices (known to those skilled in the art and, therefore, not to be described herein in detail), and the pusher means (3) provide for pushing them toward the belts (50) as far as between the parallel lengths (51) of the latter (FIGS. 1 and 2). At this point, each log (2) thus positioned results retained between the same belts (50) which, by rotating on respective driving-out rollers, direct the log toward the cutting means (4), as illustrated in FIG. 3, and engage the same log on diametrically opposite surface portions thereof. The movement of the belts (50) and thus of logs (2), is intermittent and in synchronism with the cutting means (4): in correspondence of each dwell, the means (4) are active, so that the logs (2) are cut, whereas during the movement of belts (50) the means (4) are inoperative and away from the logs (2). The speed and time of operation of the belts (50) are predetermined in relation to the length of paper rolls (20) to be obtained from the cutting of the logs (2). Once the logs (2) are held between the belts (50), the carriage (31) moves back to take up the relevant initial position, so that, when disposing further logs (2) in the channels of platform (1), these logs can be driven, again by the same pusher means, as far as to dispose the relevant head portions thereof in contact with the tail sections of the logs (2) previously handed over to the belts (50), as illustrated in FIG. 4. This process is cyclically repeated, as illustrated also in FIGS. 5-9. It thus follows that the feeding of the logs (2) to the cutting means is performed continuously, that is, without interruptions or empty spaces between consecutive logs, with evident advantages in terms of actual production of the system. The rolls, as they are produced, (20) are pushed by the same logs (2) being treated onto a conveyor belt (35) located downstream of the cutting means (4) which provides for moving them away. Possibly disposed between the conveyor belt (35) and the cutting means (4) is a stationary horizontal plane (350).

An operating method according to the invention includes, therefore, a step of push-operated longitudinal movement of the logs (2) to be cut, and a subsequent step of pull-operated longitudinal movement of the same logs (2).

The method in question may be carried out, for example, by means of the previously described apparatus and allows a continual feed of logs (2) to be obtained owing to the combination of the push and pull actions on the logs (2).

When trimmed logs are loaded onto the platform (1), it is also possible to obtain a more uniform cut quality from the first to the last of the rolls obtained from each log. It is also possible to move the belts (50) in such a manner to perform a double step of the latter when there is the passage of the tailing section of a log and of the heading section of the subsequent log in correspondence of the cutting means (4). In this case, a trimming of the logs is not to be provided (whereas, on the contrary, it is normally provided for not trimmed logs). Use of trimmed logs contributes to further increase the production.

Advantageously, in correspondence of the cutting means (4), further means (6) may be provided intended for temporarily retaining the logs (2) during the cutting step, that is, when the cutting means are activated.

The retention means (6), according to the exemplary embodiment illustrated in the figures of the attached drawings, comprise two plates (60*a*, 60*b*) each of which exhibits, on one side, a plurality of rigid, substantially semicircular hooks—hereinafter referred to as "pressers"—and, on the opposite side, an appendix (600) slidingly fitted within a guide (7) inclined at a predetermined angle to the vertical: the plates,(60*a*, 60*h*) being associated with an actuator (8) which, under control, drive them into a substantially rectilinear motion in the direction of the respective guides (7), and the same plates being disposed in parallel and mirror-like relationship, that is, orthogonally to the logs (2) to be treated.

The appendixes (600) of the plates, (60*a*, 60*b*) are provided with small rollers (63) to assist the sliding thereof within the respective guides (7).

Preferably, the guide (7) is inclined at an angle of 60° to 65° to the vertical in order to achieve what it is deemed to be an optimal combination of vertical and horizontal components of the displacement of each presser (61), and to allow the apparatus to work as best as possible whatever the diameter of the logs under treatment, thus resulting extremely versatile.

For example, the actuator (8) may be an electric motor connected to the two plates (60*a*, 60*b*) via a transmission device of crank-connecting rod type (80, 81) acting on pivots (83) going through the two plates (60*a*, 60*b*): the plates (60*a*, 60*b*) being engaged to a fixed body (100) via corresponding levers (108) each of which, on one side, is hinged to one of the two fixed bodies (100) and, on the other side, is hinged to one of the two plates (60*a*, 60*b*) above the pivots (83). The axes of the hinges, connecting the levers (108) with the plates (60*a*, 60*b*), being parallel to the pivots (83).

Figure 10:
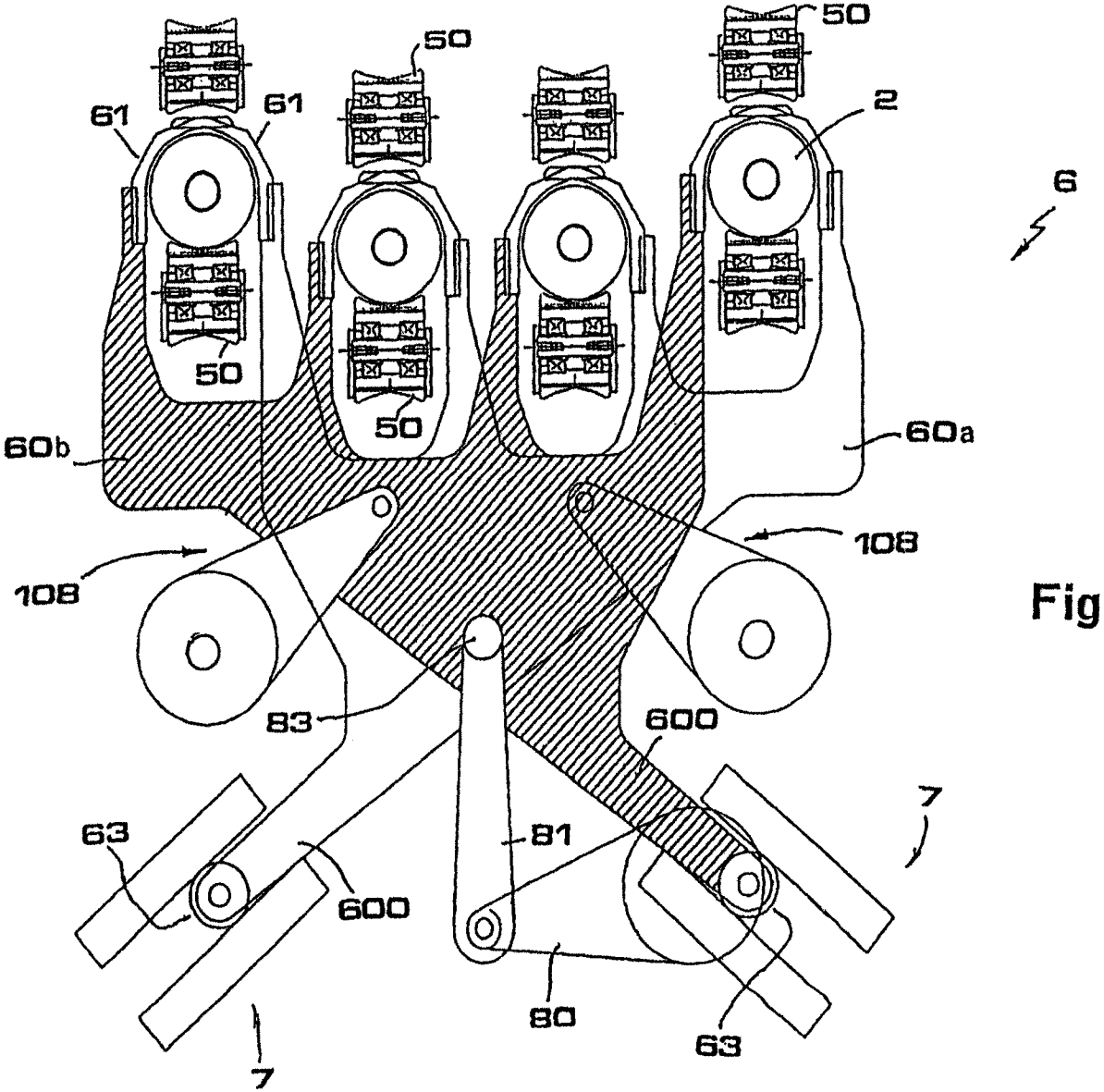
FIGS. 10 and 11 are schematic front views of the configurations taken up by the means for the temporary retention of logs of different diameter in the cutting-off station, respectively.
Figure 11:
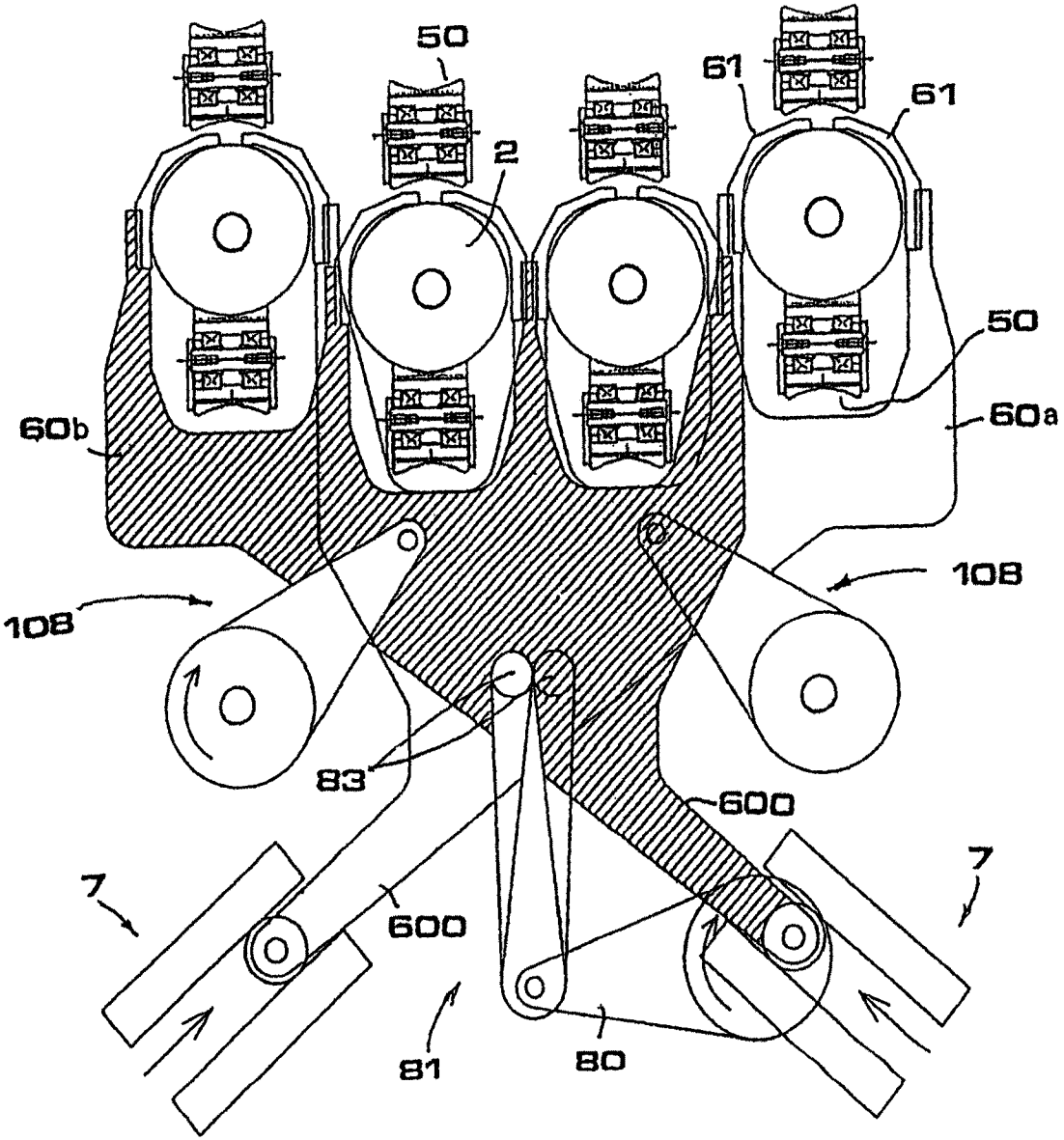
Figure 12:
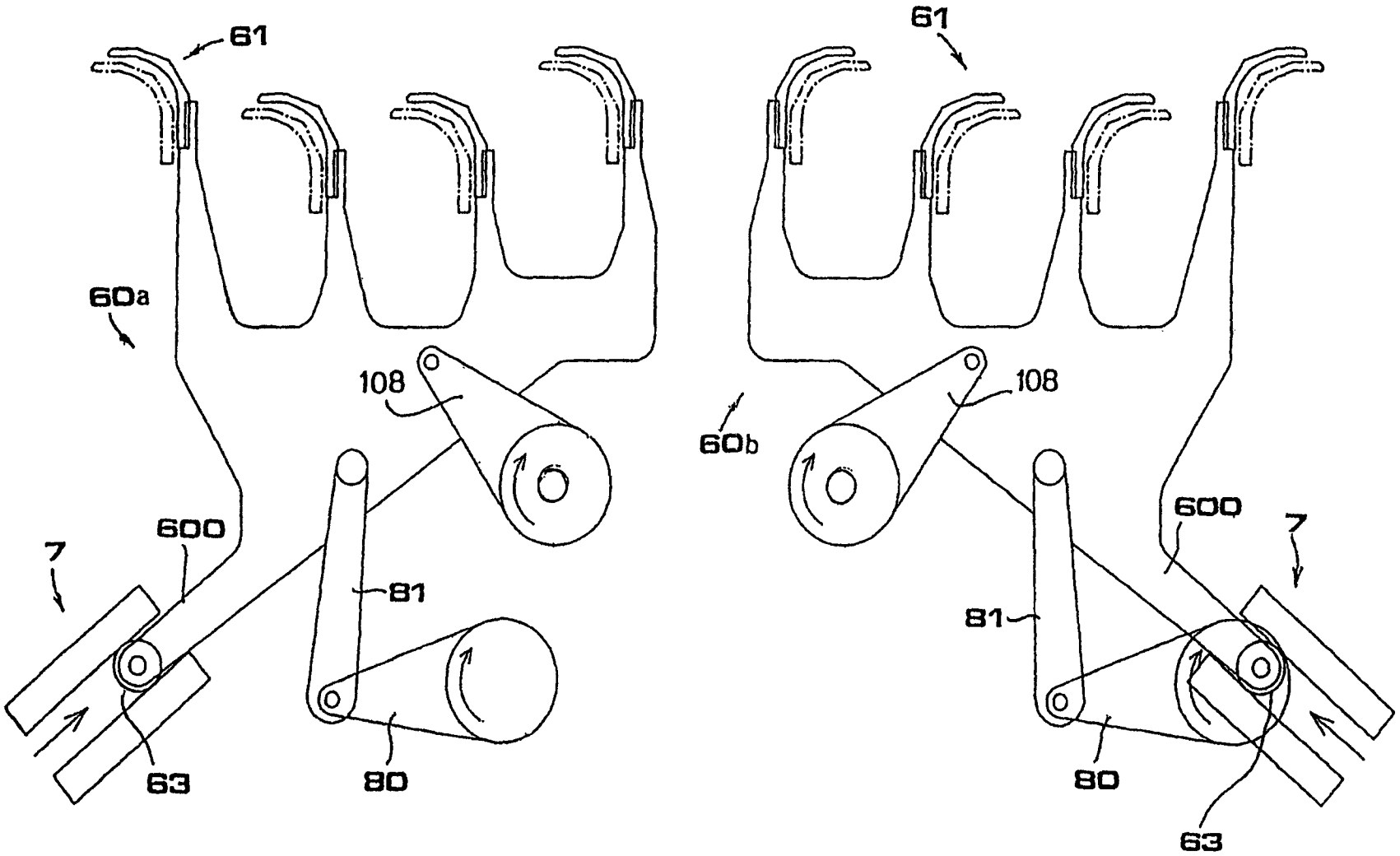
FIG. 12 is a schematic exploded side view of the retention means illustrated in FIGS. 10 and 11.
Figure 13:
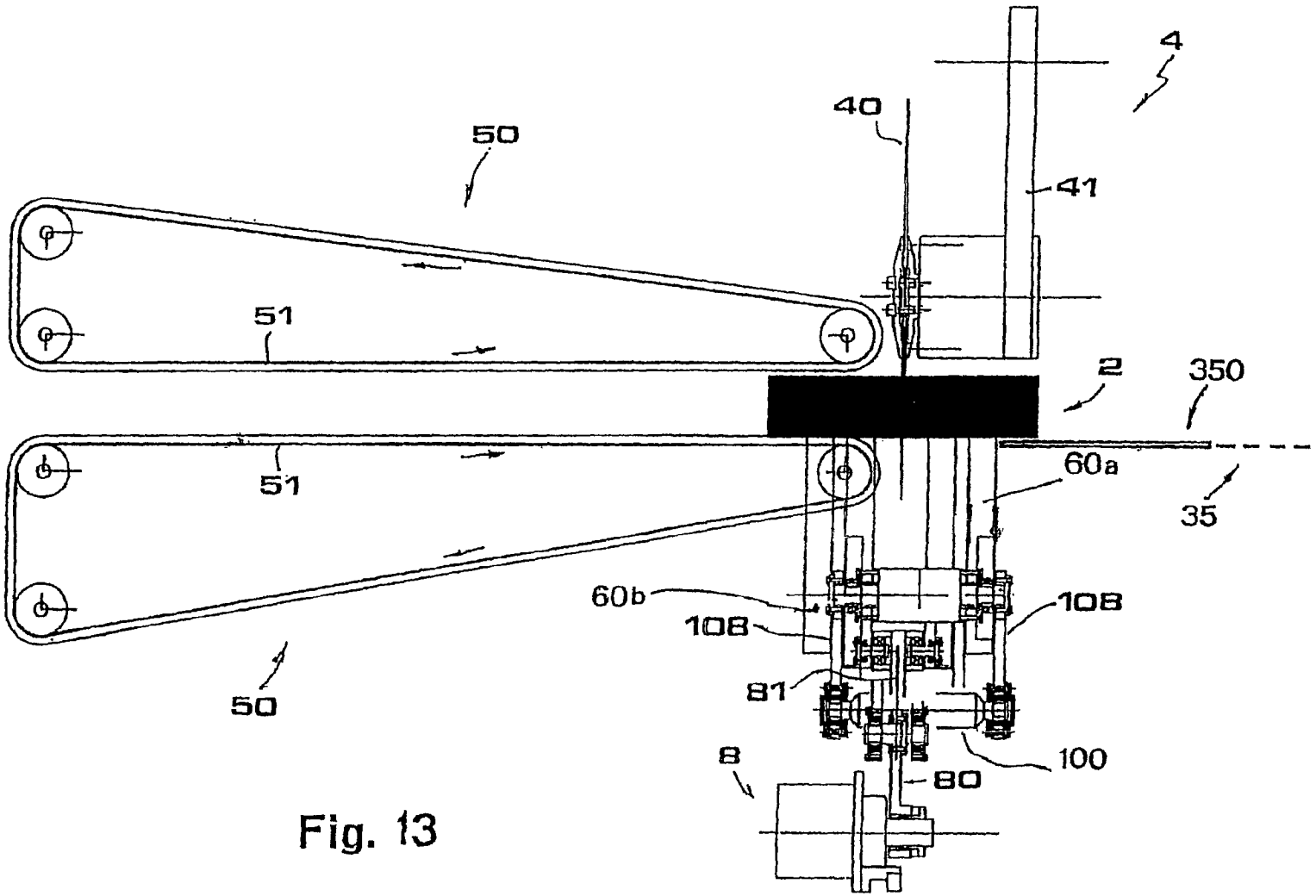
FIG. 13 is a schematic side view of the retention means illustrated in FIGS. 10 and 11.

When the cutting means (4) are inoperative and away from logs (2), the plates (60*a*, 60*b*) are lifted (as shown with dashed line in FIG. 12) so that the logs (2) result free of translating forwards (owing to the pull exerted thereon by the belts 50). Just before the beginning of the step for the cutting of logs (2), that is, when these result in cutting position, the plates (60*a*, 60*b*) are lowered (see FIGS. 10 and 11 and the drawing with solid lines in FIG. 12) by compressing the surface of the logs by means of the hooks (61) which, being approximately semicircular and in mirror-like relationship, embrace the logs laterally and on top as well, thereby retaining them in the preset position. At the bottom, the logs (2) rest in part on respective belts (50) and in part on the plane (350). The lowering and lifting of the plates (60*a*, 60*b*) is caused by the actuator (8) via the array of levers above mentioned.

The controls of pusher means (3), clamping means (5), cutting means (4) and actuator (8), the latter operating the translation of plates (60*a*, 60*b*), are all automated via corresponding programmable electronic means to which optical, photocell-operated, control means (90) are also connected, the latter being disposed along the operative path of the logs (2) at known and preset positions. Such electronic means are known to those skilled in the industrial automation field and will not, therefore, be described in greater detail.

While specific embodiments of the invention have been shown and described in detail to illustrate the application of the principles of the invention, it will be understood that the invention may be embodied otherwise without departing from such principles.

What is claimed is:

1. An apparatus for moving logs within cutting-off machines, the apparatus comprising:

a cutting means for cutting uncut logs into rolls, each of said rolls having an axial length and a radial length, said axial length being greater than said radial length;

a platform defining one or more longitudinal channels for receiving uncut logs;

a pusher means movably mounted on said platform such that said pusher means moves between an initial position and an uncut log release position relative to said platform, wherein said platform is in a fixed position with respect to said pusher means, said pusher means engaging a back end of the uncut logs in said initial position and pushing each uncut log along one of said one or more longitudinal channels toward said cutting means such that said pushing means moves from said initial position to said uncut log release position in a first direction, said first direction being defined by said one or more longitudinal channels, said cutting means being located downstream of said pusher means;

a clamping means for clamping at least one portion of the uncut logs received from said one or more longitudinal channels of said platform with said pusher means in said uncut log release position and for driving the uncut logs to said cutting means, said clamping means not being provided between said longitudinal channels of said platform, said clamping means being disposed between said pusher means and said cutting means, said pusher means moving from said uncut log release position to said initial position in a second direction with said clamping means clamping said at least one portion of the uncut logs such that said pusher means releases the uncut logs immediately upon clamping of said at least one portion of the uncut logs and said pusher means moves from said uncut log release position directly to said initial position immediately upon clamping of said at least one portion of the uncut logs, said second direction being defined by said one or more longitudinal channels, said first direction being opposite said second direction, said clamping means being provided and acting above and below each of said longitudinal channels, wherein said clamping means engages each log on an upper side and a lower side thereof, wherein the uncut logs are moved, relative to said platform and said one or more longitudinal channels, toward said cutting means via said pusher means and said clamping means, whereby a head portion of one uncut log is in contact with a tail portion of a preceding uncut log, wherein said pusher means is in direct contact with the uncut logs as said pusher means moves the uncut logs in a direction of said clamping means from said initial position to said uncut log release position, each of said one or more longitudinal channels having a length that is greater than a length of each of the uncut logs, said clamping means comprising an upper motor-driven, loop-closed belt and a lower motor-driven, loop-closed belt, said upper loop-closed belt being located opposite said lower loop-closed belt with respect to a plane on which the uncut logs are disposed on said platform, each of said loop-closed belts comprising a length parallel to said plane, said length of said upper loop-closed belt being located at a spaced location from said length of said lower loop-closed belt to define a log receiving space, said log receiving space having a size substantially equal to an outer diameter of the uncut logs, each of said longitudinal channels having a lowermost longitudinal portion defined by a longitudinal channel surface portion of the platform, said length of said lower loop-closed belt being aligned with said longitudinal channel surface portion associated with each of the longitudinal channels to define a common horizontal log supporting plane, wherein each the uncut logs moves along the common horizontal log support plane via one or more of the pusher means and the clamping means, each of the uncut logs being a paper roll.

2. The apparatus according to claim 1, wherein said pusher means comprises a bar structure having a plurality of uncut log engaging surfaces, each of said uncut log engaging surfaces being substantially perpendicular to said one or more longitudinal channels, each of said plurality of uncut log engaging surfaces being located at a spaced location from another one of said plurality of uncut log engaging surfaces, each of said uncut log engaging surfaces being aligned with one of said longitudinal channels, wherein said pusher means moves between said initial position and said uncut log release position, relative to said one or more longitudinal channels, in an exclusively linear and horizontal direction.

3. The apparatus according to claim 2, wherein said linear and horizontal direction is parallel to said one or more longitudinal channels.

4. The apparatus according to claim 1, wherein said pusher means comprises a bar structure, said bar structure comprising a bar structure surface extending continuously, without interruption, from one side of said platform to another side of said platform, said bar structure comprising a plurality of log engaging areas, each of said log engaging areas being configured to engage one of said logs in one of said longitudinal channels, each of said log engaging areas being located at a spaced location from another one of said log engaging areas, wherein said bar structure moves only in two directions, each of said two directions being parallel to said longitudinal channels.

5. The apparatus according to claim 4, wherein said bar structure is perpendicular to said longitudinal channels, said paper roll comprising web material wound about a support core.

6. The apparatus according to claim 1, wherein each of the uncut logs is not cut prior to cutting the uncut logs with the cutting means.

7. An apparatus for moving logs within cutting-off machines, the apparatus comprising:

a cutting device for cutting uncut logs into rolls such that each of said rolls has an axial length and a radial length, said axial length being greater than said radial length;

a platform comprising one or more longitudinal channels for receiving uncut logs;

a pusher means movably mounted on said platform such that said pusher means moves between an initial position and an uncut log release position relative to said platform, wherein said platform is a fixed position relative to said pusher means, said pusher means engaging a back end of the uncut logs in said initial position and pushing each uncut log along one of said one or more longitudinal channels toward said cutting means such that said pusher means moves from said initial position to said uncut log release position in a first direction, said first direction being defined by said one or more longitudinal channels, said cutting means being located downstream of said pusher means;

a clamping means for clamping at least one portion of the uncut logs received from said one or more longitudinal channels of said platform with said pusher means in said uncut log release position and for driving the uncut logs to said cutting means, said clamping means being disposed between said pusher means and said cutting means, said clamping means not being provided between the longitudinal channels, said pusher means moving from said uncut log release position to said initial position in a second direction with said clamping means clamping said at least one portion of the uncut logs such that said pusher means releases the uncut logs immediately upon clamping of said at least one portion of the uncut logs and said pusher means moves from said uncut log release position directly to said initial position immediately upon clamping of said at least one portion of the uncut logs, said second direction being defined by said one or more longitudinal channels, said first direction being opposite said second direction, wherein a portion of each of said longitudinal channels is located at an end portion of said platform, said end portion being located at an end portion height, said clamping means comprising a first belt and a second belt, said first belt being arranged at a position above said second belt, said first belt having a first belt portion, said first belt portion extending from a first position adjacent to said end portion of said platform to a second position located adjacent to said cutting device, said first position and said second position having a first height, said first height being greater than said end portion height, said second belt having a second belt portion, said second belt portion extending from another position adjacent to said end portion of said platform to yet another position located adjacent to said cutting device, said another position and said yet another position having a second height, said second height being less than said end portion height, said first position being located above said another position, said second position being located above said yet another position, said clamping means engaging each log on an upper side and a lower side thereof, wherein each log is a paper roll, the uncut logs being moved, relative to said platform and said one or more longitudinal channels, toward said cutting means via said pusher means and said clamping means, whereby a head portion of one uncut log is in contact with a tail portion of a preceding uncut log, wherein said pusher means reciprocates, relative to said platform and said one or more longitudinal channels, between said initial position and said uncut log release position in an exclusively horizontal and linear direction, said pusher means being in direct contact with the uncut logs as said pusher means moves the uncut logs in a direction of said clamping means from said initial position to said uncut log release position, said pusher means comprising a plurality of uncut log engaging surfaces, each of said plurality of uncut log engaging surfaces being located at a spaced location from another one of said plurality of uncut log engaging surfaces, each of said uncut log engaging surfaces being aligned with one of said longitudinal channels, each of said one or more longitudinal channels having a length that is greater than a length of each of the uncut logs.

8. The apparatus according to claim 7, wherein said first belt is a motor-driven, loop-closed belt, said second belt being a motor-driven, loop-closed belt, said first belt portion being located opposite said second belt portion with respect to a plane on which the uncut logs are disposed on said platform, each of said second belt portion being aligned with said plane to define a common uncut log support plane, said first belt portion being located at a spaced location from said second belt portion to define a log receiving space, said log receiving space having a size substantially equal to an outer diameter of the uncut logs.

9. The apparatus according to claim 8, further comprising:

a roll conveyor comprising a roll conveyor belt, said roll conveyor being located downstream of said clamping means and said cutting means with respect to a moving direction of the uncut logs, wherein a portion of the roll conveyor belt is aligned with said second belt portion, wherein said portion of the roll conveyor belt, said second belt portion and said plane are located in a same horizontal plane, wherein at least another portion of said first belt is located above said first belt portion and at least another portion of said second belt is located below said second belt portion.

10. The apparatus according to claim 7, wherein said linear and horizontal direction is parallel to said one or more longitudinal channels.

11. The apparatus according to claim 7, wherein said pusher means comprises a bar structure, said bar structure comprising a bar structure surface extending continuously, without interruption, from one side of said platform to another side of said platform, said bar structure comprising a plurality of log engaging areas, each of said log engaging areas being configured to engage one of said logs in one of said longitudinal channels, each of said log engaging areas being located at a spaced location from another one of said log engaging areas, wherein said bar structure moves only in two directions, each of said two directions being parallel to said longitudinal channels.

12. The apparatus according to claim 11, wherein said bar structure is perpendicular to said longitudinal channels, said paper roll comprising web material wound about a support core.

13. An apparatus for moving logs within cutting-off machines, the apparatus comprising:

a cutting device for cutting uncut logs;

a platform comprising one or more longitudinal channels for receiving uncut logs, said platform having a platform end portion, said platform end portion being located at a platform end portion height;

a pusher means movably mounted on said platform such that said pusher means moves between an initial position and an uncut log release position relative to said platform, wherein said platform is in a fixed position relative to said pusher means, said pusher means engaging a back end of the uncut logs in said initial position and pushing each uncut log along one of said one or more longitudinal channels toward said cutting means such that said pusher means moves from said initial position to said uncut log release position in a first direction, wherein said pusher means maintains contact with each of said uncut logs from said initial position to said uncut log release position, said pusher means maintaining contact with each of said uncut logs from said initial position to said uncut log release position, said first direction being defined by said one or more longitudinal channels, said cutting means being located downstream of said pusher means;

a first clamping device, said first clamping device being located at a first clamping device height, said first clamping device height being greater than said platform end portion height;

a second clamping device located opposite said first clamping device, wherein said first clamping device is located at a position above said second clamping device, said second clamping device having a second clamping device height, said second clamping device height being less than said platform end height, said first clamping device cooperating with said second clamping device to clamp at least one portion of the uncut logs received from said one or more longitudinal channels of said platform with said pusher means in said uncut log release position and to drive the uncut logs to said cutting means, said first clamping device and said second clamping device being disposed between said pusher means and said cutting means, said pusher means moving from said uncut log release position to said initial position in a second direction with said clamping means clamping said at least one portion of the uncut logs such that said pusher means releases the uncut logs in the uncut log position immediately upon clamping said at least one portion of the uncut logs and said pusher means moves from said uncut log release position directly to said initial position immediately upon clamping of said at least one portion of the uncut logs by said first clamping device and said second clamping device, said second direction being defined by said one or more longitudinal channels, said first direction being opposite said second direction, wherein a portion of each of said longitudinal channels is defined by said platform end portion, each of said longitudinal channels comprising a lowermost longitudinal channel portion, said first clamping device comprising a first belt, said second clamping device comprising a second belt, said first belt being arranged at a position above said second belt, said first belt having a first belt portion, said first belt portion extending from a first position adjacent to said platform end portion to a second position located adjacent to said cutting device, said first position and said second position having a first height, said first height being greater than said platform end portion height, said second belt having a second belt portion, said second belt portion extending from another position adjacent to said end of said platform end portion to yet another position located adjacent to said cutting device, said another position and said yet another position having a second height, said second height being less than said platform end portion height, said first position being located above said another position, said second position being located above said yet another position, said second belt portion being aligned with said lowermost longitudinal portion of each of said longitudinal channels;

a cut log conveyor located downstream of said cutting means with respect to a moving direction of said uncut logs, said cut log conveyor comprising a cut log conveyor belt, wherein a portion of said cut log conveyor belt is aligned with said second belt portion and said lowermost longitudinal portion of each of said longitudinal channels, wherein said portion of the cut log conveyor belt, said second belt portion and said lowermost longitudinal portion of each of said longitudinal channels are located in a same horizontal plane, said first clamping device engaging each log on an upper side thereof and said second clamping device engages each log on a lower side thereof, wherein each log is a paper roll, the uncut logs being moved toward said cutting means via said pusher means, said first clamping device and said second clamping device, whereby a head portion of one uncut log is in contact with a tail portion of a preceding uncut log, said pusher means reciprocating between said initial position and said uncut log release position, relative to said platform and said one or more longitudinal channels, in an exclusively linear and horizontal direction, said pusher means being in direct contact with the uncut logs as said pusher means moves the uncut logs in a direction of said clamping means from said initial position to said uncut log release position, said pusher means comprising a plurality of uncut log engaging surfaces, each of said plurality of uncut log engaging surfaces being located at a spaced location from another one of said plurality of uncut log engaging surfaces, each of said uncut log engaging surfaces being aligned with one of said longitudinal channels.

14. The apparatus according to claim 13, wherein each of said one or more longitudinal channels has a length that is greater than a length of each of the uncut logs, wherein the uncut logs move relative to said platform and said one or more longitudinal channels, said cutting means cutting said uncut logs into rolls, each of the rolls having an axial length and a radial length, the axial length being greater than the radial length, said first clamping device and said second clamping device not being provided between the longitudinal channels of the platform.

15. The apparatus according to claim 13, wherein said first belt is a first motor-driven, loop-closed belt and said second belt is a second motor-driven, loop-closed belt, said first belt being located opposite said second belt with respect to a plane on which the uncut logs are disposed on said platform, said first belt portion and said second belt portion being parallel to said plane, said first belt portion being located at a spaced location from said second belt portion to define a log receiving space, said log receiving space having a size substantially equal to an outer diameter of the uncut logs.

16. The apparatus according to claim 15, wherein said log receiving space is substantially aligned with each of said longitudinal channels.

17. The apparatus according to claim 13, wherein at least another portion of said first belt is located above said first belt portion and at least another portion of said second belt is located below said second belt portion.

18. The apparatus according to claim 13, wherein said linear and horizontal direction is parallel to said one or more longitudinal channels.

19. The apparatus according to claim 13, wherein said pusher means comprises a bar structure, said bar structure comprising a bar structure surface extending continuously, without interruption, from one side of said platform to another side of said platform, said bar structure comprising a plurality of log engaging areas, each of said log engaging areas being configured to engage one of said logs in one of said longitudinal channels, each of said log engaging areas being located at a spaced location from another one of said log engaging areas, wherein said bar structure moves only in two directions, each of said two directions being parallel to said longitudinal channels.

20. The apparatus according to claim 19, wherein said bar structure is perpendicular to said longitudinal channels, said paper roll comprising web material wound about a support core.

* * * * *